US012078434B2

(12) United States Patent
Delgado Acarreta et al.

(10) Patent No.: US 12,078,434 B2
(45) Date of Patent: Sep. 3, 2024

(54) DEVICE AND METHOD FOR SECURING A GUN

(71) Applicant: RADE TECNOLOGÍAS S.L, Saragossa (ES)

(72) Inventors: Raúl Delgado Acarreta, Saragossa (ES); Diego Lorente Algora, Saragossa (ES); David Puértolas Sanz, Saragossa (ES); Javier Atrián Blasco, Saragossa (ES)

(73) Assignee: RADE TECNOLOGÍAS, S.L., Saragossa (ES)

( * ) Notice: Subject to any disclaimer, the term of this patent is extended or adjusted under 35 U.S.C. 154(b) by 535 days.

(21) Appl. No.: 17/424,332

(22) PCT Filed: Nov. 12, 2019

(86) PCT No.: PCT/ES2019/070774
§ 371 (c)(1),
(2) Date: Jul. 20, 2021

(87) PCT Pub. No.: WO2020/152375
PCT Pub. Date: Jul. 30, 2020

(65) Prior Publication Data

US 2022/0090875 A1 Mar. 24, 2022

(30) Foreign Application Priority Data

Jan. 21, 2019 (EP) ..... 19382041

(51) Int. Cl.
*F41A 17/56* (2006.01)
*F41A 7/06* (2006.01)
(Continued)

(52) U.S. Cl.
CPC ..... *F41A 17/56* (2013.01); *F41A 7/06* (2013.01); *F41A 17/46* (2013.01); *F41A 17/64* (2013.01)

(58) Field of Classification Search
CPC ..... F41A 17/06; F41A 17/063; F41A 17/46; F41A 17/56; F41A 17/64
See application file for complete search history.

(56) References Cited

U.S. PATENT DOCUMENTS 4,457,091 A * 7/1984 Wallerstein ..... F41A 17/04 42/70.11
5,705,763 A * 1/1998 Leon ..... F41A 19/33 89/128

(Continued)

FOREIGN PATENT DOCUMENTS

EP 3392597 A1 10/2018

OTHER PUBLICATIONS

International Search Report issued Jun. 18, 2020 re: Application No. PCT/ES2019/070774, pp. 1-3, citing: EP 3 392 597 A1, US 2014/360073 A1 and US 9 222 744 B2.

(Continued)

*Primary Examiner* — Gabriel J. Klein
(74) *Attorney, Agent, or Firm* — Hassan Abbas Shakir; Shakir Law PLLC

(57) ABSTRACT

A device for securing a weapon with a safety, the device having a safety body adapted to contact a sear of the safety, and a movable actuating element between a first position and a second position. The actuating element and the safety body are adapted to make the device configurable between at least: a firing state wherein the actuating element is in the first position, causing the sear to slide through the safety body; and a safe state wherein the actuating element is in the second position, causing the sear not to slide through the safety body. Also, a trigger mechanism housing and a (Continued)

weapon which include the device and a method for securing a weapon by a safety of the weapon and a device for securing a weapon.

20 Claims, 11 Drawing Sheets

(51) Int. Cl.
*F41A 17/46* (2006.01)
*F41A 17/64* (2006.01)

(56) References Cited

U.S. PATENT DOCUMENTS 6,308,448 B1 * 10/2001 Kapusta ..... F41A 19/31 42/69.02
6,442,880 B1 * 9/2002 Allan ..... F41A 17/066 42/70.11
6,560,909 B2 5/2003 Cominolli
7,051,468 B2 * 5/2006 Glock ..... F41A 17/02 42/70.04
9,222,744 B2 * 12/2015 Beck ..... F41A 17/64
2002/0194762 A1 * 12/2002 Cominolli ..... F41A 17/72 42/70.06
2013/0000173 A1 * 1/2013 Green ..... F41A 17/72 42/70.11
2014/0360073 A1 12/2014 Stewart et al.
2019/0041149 A1 * 2/2019 Cusano ..... F41A 19/06
2023/0047756 A1 * 2/2023 Chandler ..... F41A 17/28
2023/0251050 A1 * 8/2023 Fellows ..... F41A 17/46 42/69.01

OTHER PUBLICATIONS

Written Opinion issued Jun. 18, 2020 re: Application No. PCT/ES2019/070774, pp. 1-6, citing: EP 3 392 597 A1 and US 2014/360073 A1.

* cited by examiner

DEVICE AND METHOD FOR SECURING A GUN

TECHNICAL FIELD

The present disclosure relates to a device and a method for securing weapons, which has an application in the weapons industry and, more specifically, in the field of safeties for automatic and semi-automatic weapons, even including the adaptation of already existing weapons by incorporating the device of the disclosure, which is made up of a safety that is additional to and, preferably, independent of the original safety or safeties of that weapon, manipulable or not by the user. A particularly advantageous, but not limiting, application of the disclosure is its use in shooting ranges where inexperienced users participate in shooting sessions for training purposes, such that a controlling user can control the state of all of the weapons present in the range through this additional safety included in the weapon if desired.

BACKGROUND

Nowadays, there are different safety methods for short and long firearms in order to avoid accidental shots. Usually those safety methods act in different ways on the trigger bar, being possible to control the weapon at the same time as the trigger is pulled.

Some existing solutions modified the trigger mechanism housing for blocking the trigger bar.

For example, patent document U.S. Pat. No. 6,560,909 presents a safety system where the trigger mechanism is modified and the state of blocking or unblocking of the weapon is chosen through a selection lever. However, despite providing a solution to an accidental shot, this approach is manual and does not offer additional protection when the trigger is pulled.

Another example of manual safety for weapons is document U.S. Pat. No. 9,222,744, which describes a safety that displaces the connector in such a way that when the trigger is pulled, the trigger bar does not interact with the connector, the trigger bar not being able to release the firing pin for shooting.

Therefore, there is still a need in the state of the art of an additional safety mode capable of preventing accidental shooting, even when the user is pulling the trigger bar and, further, which can be controlled by another user.

SUMMARY

The present disclosure relates to a device for securing weapons, additional to the original safety or safeties of the weapon, which comprises an additional safety mechanism, such that the safe state prevails in either of the two systems, namely, the original safety or the additional mechanism, in such a way that, if any of the two is in the safe position, the weapon will be in the safe position. In this way, semi-automatic and automatic weapons are secured in two different and independent ways thanks to the device, so that the original function of the weapon is maintained and, in addition, an additional safety independent of the original safety is included, which can be controlled mechanically or electronically by the user who carries the weapon, and/or remotely by another controlling user and/or depending on the shooting direction of the weapon.

In the context of this disclosure, by "weapon" it is meant any small or light weapon, such as a firearm, rifle, shotgun, airgun, submachine gun, pistol, rifle, revolver, etc., and also any non-lethal weapon or archery weapon.

In the context of the present disclosure, by "sear" it is meant any part of the firing mechanism of a weapon between the trigger and the firing pin. In some embodiments, the sear is the trigger bar of the weapon.

The present disclosure relates to a device for securing a weapon, the weapon comprising a trigger, and a safety (e.g. a first safety), the safety comprising a movable sear between a safe position that prevents a firing pin of the weapon from being released and a firing position that allows the firing pin to be released when a trigger of the weapon is pulled. The sear is located into the path of movement of a firing pin to prevent the firing pin from being released, and also makes it possible for the sear to release the firing pin when the trigger is pulled.

Therefore, according to a first aspect of the present disclosure, the device acts as an additional safety (e.g. a second safety), the device comprising an actuating element and a safety body, the actuating element being movable between: a first position in which the actuating element is located into a path of movement of the safety body in a direction of movement of the safety body, and a second position in which the actuating element is located out of the path of movement of the safety body in the direction of movement of the safety body. The actuating element and the safety body are adapted to make the device configurable between at least: a firing state in which the actuating element is in the first position that does not allow the movement of the safety body in the direction of movement, causing the sear to slide through the safety body and, in this way, is able to release the firing pin only when the safety is in the firing position, thus allowing a user to shoot; and a safe state in which the actuating element is in the second position that allows the movement of the safety body in the direction of movement, causing the sear not to slide through the safety body and, in this way, is not be able to release the firing pin, thus preventing the firing pin from releasing, and not to allow the user to shoot neither when the safety is in the firing position nor when the safety is in the safe position.

In this way, the device determines the state of the weapon between, at least, the firing state, wherein the sear can release the firing pin to shoot when the trigger is pulled and the safety releases the firing pin and, therefore, the safety and the device are released, allowing the user to shoot; and the safe state, wherein the sear cannot release the firing pin to shoot, preventing the firing pin from releasing in the following cases (thus preventing the user from shooting):

- when the safety is in the safe position (that is, the sear is in the safe position) and the device is in the firing state,
- when the safety is in the firing position (that is, the sear is in the firing position) and the device is in the safe state,
- when the safety is in the safe position and the device is in the safe state.

This disclosure is especially useful where inexperienced users participate in shooting galleries for training purposes, although it is not limited to its exclusive use in shooting galleries. A controlling user can control the state of all weapons present in the gallery through the device, which acts as an additional safety. Inexperienced users control the state of the weapon through the original safety devices of the weapon, but a controlling user can control the additional safety, such that any weapon can be activated/deactivated at any time through the additional safety, thereby avoiding possible accidents.

In the following table, it is possible to see schematically the operation of the safety and the device (additional safety), as well as the state of the weapon. The position of the safety and the device can be "safe" or "firing", while the state of the weapon changes between "safe" and "firing". Throughout the specification, when "additional safety" is mentioned, reference is made to the device.

| Safety | Device | State of the weapon |
|---|---|---|
| Firing position | Firing position | Firing |
| Safe position | Firing position | Safe |
| Firing position | Safe position | Safe |
| Safe position | Safe position | Safe |

In the first and second columns one can see the state of the safety and the additional safety, respectively. That it is to say, if the trigger is pulled, the safety is in the "firing position", and if the trigger is not pulled, the safety is in the "safe position". When the weapon is activated for firing, the device is in the firing state (that is, the actuating element is in the first position), and when the weapon is deactivated for firing, the device is in the safe state (that is, the actuating element is in the second position). The state of the weapon is shown in the third column.

When the device is in the firing state and the trigger is pulled, the weapon realizes a shot. This is illustrated in the first row of the table.

If the device is in the firing state and the trigger is not pulled, no shot is produced. This is shown in the second row of the table.

If the device is in the safe state and the trigger is pulled, no shot is produced. This is shown in the third row of the table.

If the device is in the safe state and the trigger is not pulled, no shot is produced. This is shown in the fourth row of the table.

As concluded from the table above, even if the safety is in the firing position, the user can only shoot if the device is in the firing position, so the device governs the final operation of the weapon.

In some embodiments, the device further comprises a pusher configured to change the configuration of the device from the firing state to the safe state, by displacing the actuating element from the first position to the second position. In some of these embodiments and in other embodiments (e.g. where the device does not comprise an elastic element for the actuating element as described below), the pusher is either configured or also configured to change the configuration of the device from the safe state to the firing state by displacing the actuating element from the second position to the first position. In some of these embodiments, the device also includes a motor joined to the pusher to move said pusher.

The pusher can be actuated by the user who carries the weapon, as an example, mechanically (e.g. by pressing or pulling the pusher), or electronically, for which an instruction is digitally sent to the motor that mechanically moves the pusher. Likewise, another user who is not the user who carries the weapon can also act the pusher electronically, as described above.

In some embodiments, the device further comprises a first elastic element (for the safety body). The first elastic element (e.g. a spring) contacts the safety body and is adapted to contact a trigger mechanism housing of the weapon, being the first elastic element configured to arrange the safety body in a contact position with the sear, so that the device is in the firing state.

This elastic element for the safety body provides resistance to the movement of the safety body according to the direction of movement of the latter. Thanks to this resistance, when the safety body has moved as a result of the pressure and sliding of the sear on the safety body, the elastic element tends to recover its original shape, forcing the safety body to recover its initial position once the sear stops pressing on the safety body.

In some of these embodiments and in other embodiments, the device further comprises a second elastic element (for the actuating element) that contacts the actuating element and adapted to contact a trigger mechanism housing (the same trigger mechanism housing that contacts the first elastic element in the embodiments in which the device comprises the first and second elastic elements), being the second elastic element (e.g. a spring) configured to arrange the actuating element in the first position, so that the device is in the firing state.

This elastic element for the actuating element provides resistance to the movement of the actuating element according to the direction of movement of the latter (in preferred embodiments, this movement is a rotation). Thanks to this resistance, when the actuating element is in the second position (in which the actuating element is out of the path of movement of the safety body) and it is desired to move it to the first position, the elastic element tends to recover its original shape, forcing the actuating element to move to the first position.

In embodiments wherein the device comprises the pusher, preferably the pusher does not displace the actuating element from the second position to the first position to change the configuration of the device from the safe state to the firing state, but the pusher is configured to move to an initial position (from which it begins to displace the actuating element from the first position to the second position) and the second elastic element forces the displacement of the actuating element from the second position to the first position to change the configuration of the device from the safe state to the firing state.

In addition, in some of these embodiments, the second elastic element is further configured to arrange the actuating element in the first position when the actuating element is in the second position and the safety body is displaced according to the path of movement, and where the second elastic element arranges the actuating element in the first position when the safety body is no longer displaced according to the path of movement.

The elastic element for the actuating element can configure the device to the firing state when, being in the safe state, the actuating element has been displaced according to the path of movement (and according to the direction of movement). The latter happens when the trigger of the weapon has been pulled and the sear of the safety presses the safety body, forcing the displacement of said safety body as the actuating element is out of the path of movement of the safety body. While the trigger is pulled, the safety body is displaced and contacts the trigger mechanism housing of the weapon; in this situation, the actuating element cannot move to the first position due to the safety body's obstruction. However, the second elastic element tries to recover its initial shape, so, as soon as the safety body moves back to its initial position (which happens when the trigger of the weapon is released), the second elastic element begins to recover its initial shape, thus forcing the movement of the actuating element to the first position, configuring the device to the firing state. This, in turn, allows that when releasing the trigger, the actuating element is already in the first position, so that when the trigger is pulled again, the device is already in the firing state, allowing the shot. In other words, it is not necessary to wait until the trigger is released and the safety body returns to its initial position to then act the device and configure it to the firing state, but the second elastic element already configures the device in this way as soon as the safety body returns to its initial position.

As can be seen, in embodiments where the device comprises the pusher, the state of the device is always known thanks to the position of the pusher. This, for example, can be done by means of a magnet, a switch and others. This means that, in the event of a possible failure, this device will alert the user of the weapon. In this hypothetical case, it is possible that the user think that the actuating element is in the second position (and, therefore, the device is in the safe state), but due to a failure in the system, the actuating element would be in the first position (and, therefore, the device is in the firing state), being an important safety problem. To solve this problem, the elastic element for the actuating element leaves the actuating element in the first position (and, therefore, the device in firing state) by default. With this solution, if there is a failure in the device, the device will indicate the firing state instead of the safe state, which is not a safety problem. Otherwise, the device is in the safe state instead of in the firing state, which would imply a safety problem, such as an accidental shot.

In some embodiments, the device further comprises a battery electrically connected to the motor. In some of these embodiments, the battery is located in a battery housing adapted to be located in or near the barrel of the weapon, wherein the battery is electrically connected to the motor by means of a backstrap adapter of the weapon, which extends from the grip area to the barrel area of the weapon.

In some examples, the device further comprises a processing unit and a sensor circuit to control the state of the device. The processing unit and the sensor circuit are electrically connected to the battery.

The processing unit allows the device to be configured between firing and safe states electronically, for example, by actuating the motor, which moves the pusher that changes the position of the actuating element. The sensor circuit, which is connected to the processing unit, may be provided with one or more physical buttons and thus indicate to the processing unit that the configuration of the device must be changed. One or more buttons may be adapted to be placed on the weapon for manipulation by a user, or adapted to be placed on a wearable device or garment by a user, or adapted to be part of a controller. One or more buttons may be electrically connected to the sensor circuit, or they may send instructions by wireless signals. The sensor circuit may be equipped with a wireless communications module, which includes an antenna for radio frequency communications, so that it can receive and, in some embodiments, transmit data wirelessly.

In some embodiments, the sensor circuit is configured to wirelessly receive a signal which represents a configuration instruction of the device to the safe state or of configuration of the device to the firing state. In these embodiments, the processing unit is configured to process that signal and to operate the motor so that the pusher moves the actuating element to the first position or to the second position according to the instruction of that signal.

This signal allows to control remotely the state of the device, for example, by a controlling user on a shooting range. By means of the signal, which can be emitted from an electronic apparatus with a wireless communications module and which may or may not be part of the device, the processing unit is instructed to change the state of the device either so that the weapon is in a firing state or in a safe state; the possibility of firing, however, will also depend on the position of the safety as described. When the instruction sent by means of the signal is to change to a state in which the device is already in, the processing unit does not operate the motor so that the device is maintained in the state indicated in the instruction.

In some embodiments, the device further comprises a transmitter module, which can be operated by the user carrying the weapon or by a person who does not carry the weapon; the transmitter module is configured to transmit, to the sensor circuit, a signal that represents at least one identification code associated with an user. In these embodiments, the processing unit is configured to validate the at least one identification code of the received signal by the sensor circuit and to allow the change of the state of the device and, as a function of the validation, to allow or to prevent the change of the state of the device between the firing and safe states by the user of the weapon or by another different user than the user of the weapon.

The transmitter module can be adapted to be worn by a user in close proximity to the users own body; for example, the transmitter module can be attached to a wearable device that can be worn by the user. The transmitter module can be configured to capacitively transmit a signal that represents at least one identification code associated with the user. In turn, the sensor circuit is configured to receive the signal transmitted by the transmitter module, provide it to the processing unit, and the processing unit allow or prevent a user from changing the state of the device, mechanically or electronically, when at least one identification code has been validated or not, respectively.

In some embodiments, the device is configured to remain in the safe state and/or switch to the safe state when the weapon points outside a predetermined area.

In some embodiments, the safety body is adapted to replace a weapon connector. In this respect, the safety body has a geometry and dimensions suitable for use as a weapon connector. Therefore, a weapon that already has a connector can incorporate the device of the present disclosure by replacing that connector by the device.

In some embodiments, the actuating element is a lever or a rocker arm.

In some embodiments, the weapon is a weapon with a striker fired system, e.g. a pistol with a striker fired system.

In a second aspect of the disclosure, a trigger mechanism housing is described, which incorporates any embodiment and/or preferred choice of the device for securing a weapon of the first aspect of the disclosure.

In some embodiments, the device is located, at least partially, in said trigger mechanism housing.

In a third aspect of the disclosure, a weapon is disclosed that incorporates any embodiment and/or preferred choice of the device for securing a weapon of the first aspect of the disclosure, or of the trigger mechanism housing of the second aspect of the disclosure. The weapon also includes at least the safety with the movable sear between the safe position and the firing position, the firing pin, and the trigger.

In some embodiments, the safety body of the device is a connector of the weapon.

In a fourth aspect of the disclosure, the disclosure also relates to a method for securing a weapon by means of a safety of the weapon (e.g. a first safety) and a device for securing a weapon (e.g. an additional safety or second safety), the safety comprising a movable sear between a safe position that prevents a firing pin of the weapon from being released and a firing position that allows the firing pin to be released when a trigger of the weapon is pulled, the device comprising a movable actuating element and a safety body, the method comprising:

- to arrange the device in the weapon in such a way that contact the sear;
- to slide the sear through the safety body and, in this way, the sear releases the firing pin to allow a user to shoot when the actuating element is in a first position wherein is in a path of movement of the safety body in a direction of movement and does not allow the movement of the safety body in a direction of movement, and only when the safety is in the firing position;
- to prevent that the sear slides through the safety body and, in this way, the sear is not able to release the firing pin in order not to allow the user to shoot when the actuating element is in a second position in which is out of the path of movement of the safety body and allows the movement of the safety body in the direction of movement, neither when the safety is in the firing position nor when the safety is in the safe position; and
- to move the actuating element between the first position and the second position to allow and to prevent that the sear slides through the safety body, respectively.

In some embodiments, the device is a device according to the first aspect of the disclosure.

In some embodiments, the weapon comprises a trigger mechanism housing according to the second aspect of the disclosure.

In some embodiments, the weapon is a weapon according to the third aspect of the disclosure.

The different aspects and achievements of the disclosure defined above may be combined with each other, provided they are compatible with each other.

From the detailed description that follows, the advantages and additional characteristics of the disclosure will be evident, which will be particularly highlighted in the attached claims.

BRIEF DESCRIPTION OF THE DRAWINGS

In order to help understand the characteristics of the disclosure, according to a preferred practical embodiment of the disclosure and to complement this description, the following figures are attached as an integral part of this description, which have an illustrative character and not limitative.

DETAILED DESCRIPTION OF THE DRAWINGS

Below is a detailed description of the device for securing a weapon and the method for securing a weapon of the present disclosure.

Figure 1:
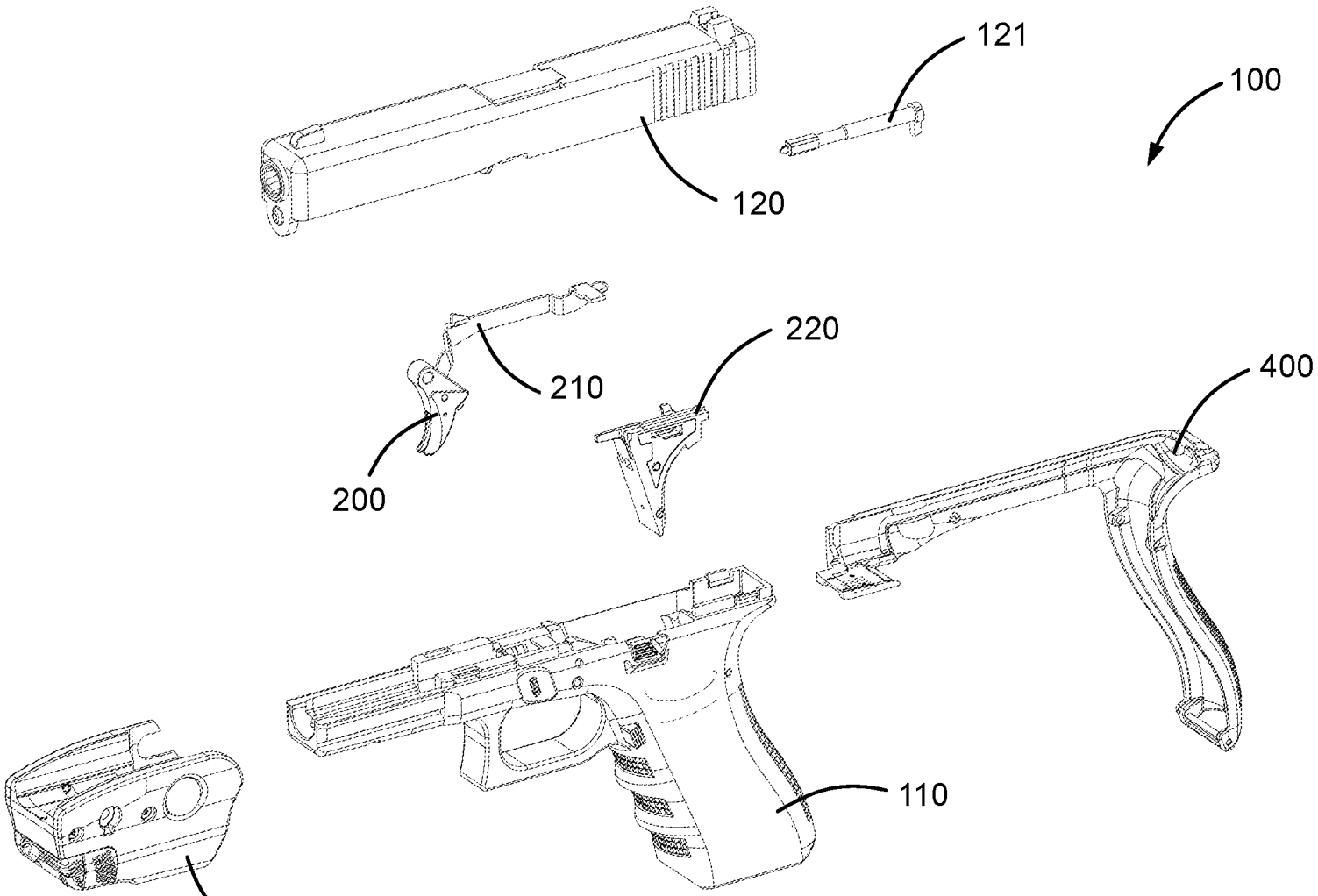
FIG. 1 shows an exploded perspective view of a weapon that includes the device for securing a weapon according to an embodiment.

FIG. 1 presents a non-limiting example of an application scenario of the disclosure. A weapon (100) is presented, in this particular case, a pistol with striker fired system corresponding to a Glock 17 pistol; another example of pistol with striker fired system is H&K SFP9. Note, however, that this disclosure can be adapted to any other weapon design.

FIG. 1 shows an exploded perspective view of a weapon (100) comprising the device for securing a weapon according to a preferred embodiment of the present disclosure. The weapon (100) includes a frame (110), a slide (120), a firing pin (121), a trigger (200), a trigger bar (210), a safety (e.g. a first safety), a firing mechanism housing (220) in which the device is at least partially arranged, a battery housing (300) which can form part of the device, and a backstrap adapter (400) according to a preferred embodiment of the disclosure.

The safety comprises a sear which, preferably but not necessarily, is the trigger bar (210). The sear can be moved at least between a safe position, in which the sear is located into the path of movement of the firing pin (121) to prevent the firing pin (121) from being released, and a firing position, in which the sear releases the firing pin (121) when the trigger (200) is pulled. Therefore, when the trigger (200) is pulled, the trigger bar (210) moves according to the direction of movement of the trigger bar (210), which may allow the firing pin (121) to be released, and when the trigger (200) is released, the trigger bar (210) moves back to the initial position.

Figure 2:
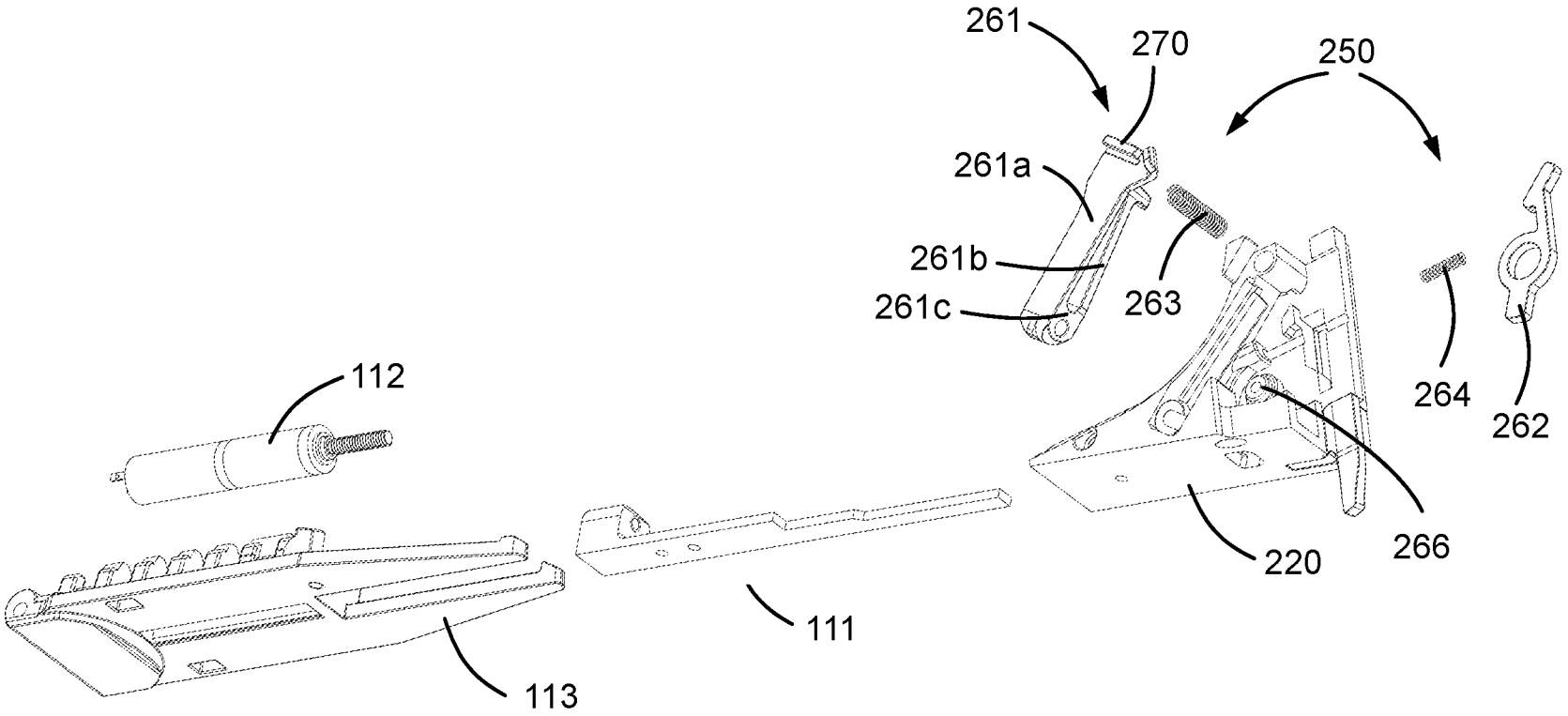
FIG. 2 shows in greater detail an exploded perspective view of the device, according to a preferred embodiment of the disclosure.

In a preferred embodiment, such as the one shown in FIG. 2, the device (250) acts as an additional safety (e.g. as a second safety), the operation of which is not dependent on the safety (e.g. first safety) of the weapon. The device (250) comprises an actuating element (262) and a safety body (261); the safety body (261) can be made from a single piece or from independent pieces joined together when moving. The device (250) determines the state of the weapon (100), between at least one firing state (as illustrated, for example, in FIGS. 3A, 3D, 4A, 4B, 4G, 4H and 5A) and a safe state (as illustrated, for example, in FIGS. 3B, 3C, 4C-4F and 5B).

Figure 3A:
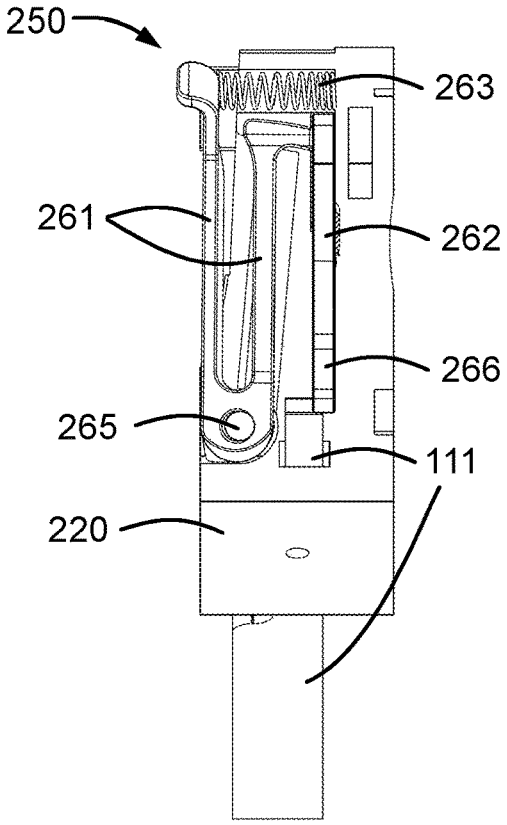
FIGS. 3A-3D present four cross-sectional views of an embodiment of the device, according to a preferred embodiment of the disclosure.
Figure 3B:
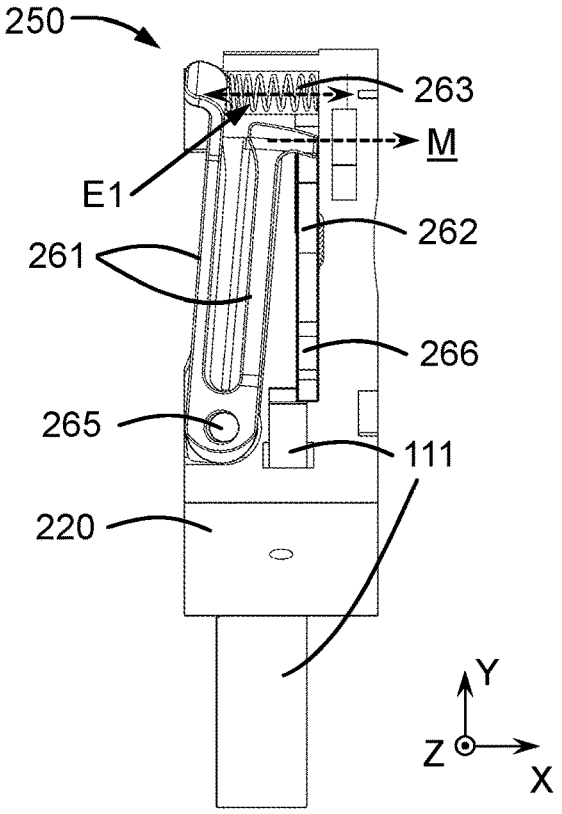
Figure 5A:
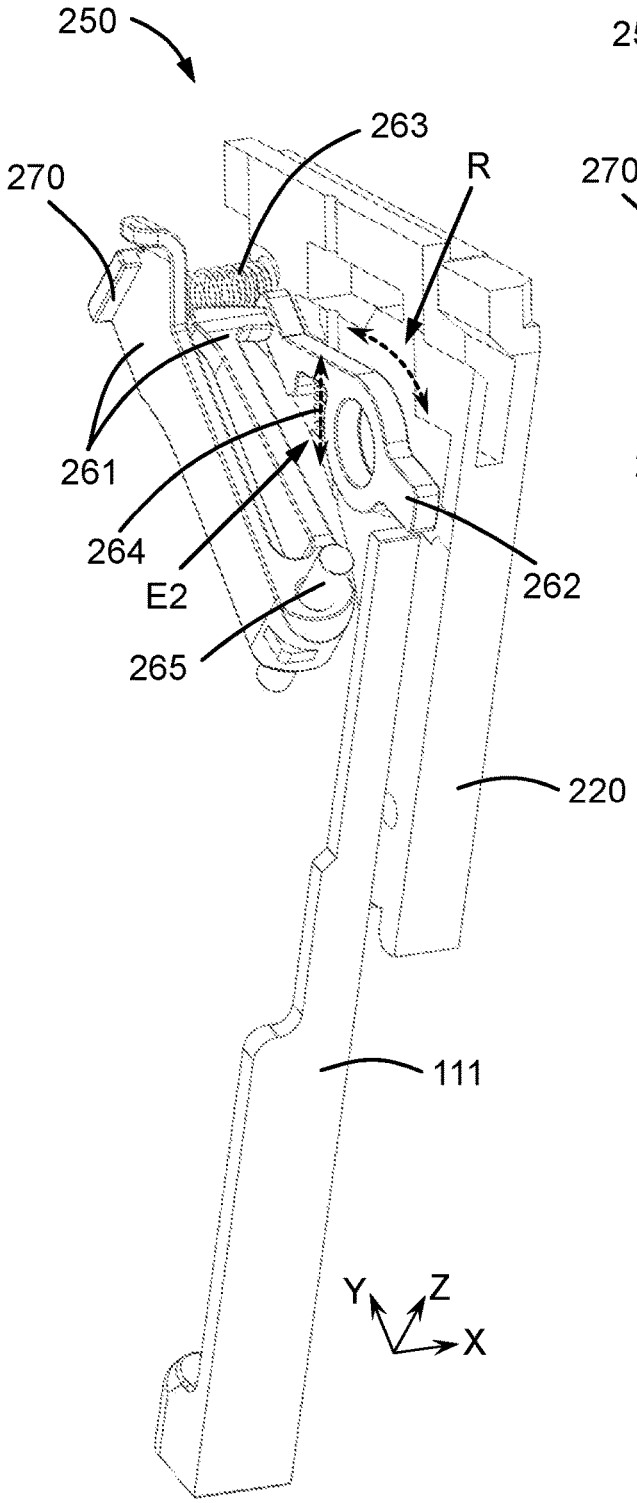
FIGS. 5A-5B present two perspective views of the device, according to a preferred embodiment of the disclosure.
Figure 5B:
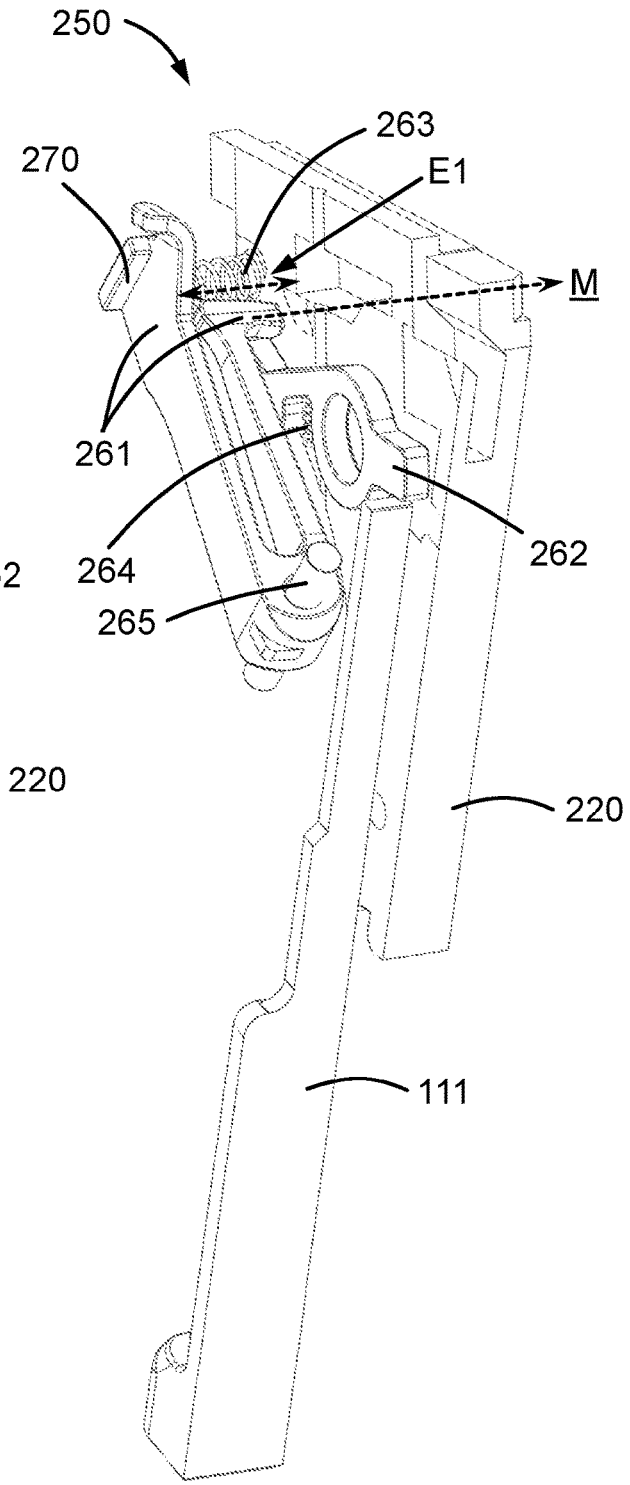

In the firing state, the actuating element (262) is located into a path of movement of the safety body (261), which does not allow the movement of the safety body (261) in a direction of movement (M)—this direction is illustrated in FIGS. 3B and 5B—. As the safety body (261) cannot move, the sear—for example the trigger bar (210) in FIG. 1—slides through the safety body (261) by pressing a protrusion (270) of the safety body (261). In this way, the sear is able to release the firing pin (121) to shoot when the trigger (200) is pulled and the safety releases the firing pin (121), thus releasing the safety and the device (250), allowing the user to shoot. In the safe state, the actuating element (262) is located out of the path of movement of the safety body (261), which allows the safety body (261) to move in the direction of movement (M). By moving the safety body (261), the sear is prevented from sliding through the safety body (261) during the entire travel made by the sear due precisely to the movement made by the safety body (261). This movement of the safety body (261) causes the sear not to be able to press on the protrusion (270) during the entire travel, which is necessary to release the firing pin (121). It is therefore not possible to shoot when the device is in the safe state, thus preventing the firing pin (121) from being released.

FIG. 2 shows the trigger mechanism housing (220) including the device (250) according to a preferred embodiment of the disclosure.

The safety body (261) comprises first and second arms (261*a*, 261*b*) which are joined by a joining part (261*c*); in this embodiment the safety body (261) is a single piece, that is, it is made up of a single piece. The safety body (261) is provided with a protrusion (270) adapted to be pressed or pushed by the sear when the latter slides through the safety body (261); the protrusion (270) is in the first arm (261*a*) to be pressed or pushed by the sear. The safety body (261) has a hole in the joining part (261*c*) through which a shaft is passed—for example, the shaft (265) illustrated in FIGS. 3A-3D, 4A-4H and 5A-5B— which allows the rotation of the safety body (261) according to a direction of movement (M).

In the embodiment of FIG. 2, the device (250) further comprises a pusher (111), and in this embodiment it also comprises a motor (112) to which the pusher (111) is joined. The pusher (111) is configured to displace the actuating element (262) from a first position, corresponding to the firing state of the device (250), to a second position, corresponding to the safe state of the device (250). In addition, or alternatively, the pusher (111) is configured to displace the actuating element (262) from the second position, corresponding to the safe state of the device (250), to the first position, corresponding to the firing state of the device (250). In a preferred embodiment, as illustrated in FIG. 2, the motor (112) is located in a motor housing (113) which is also part of the device (250).

FIGS. 3A-3D show the different positions of the sear of the safety and the different states of the device (250) according to a preferred embodiment of the disclosure. In these figures, the device (250) is shown together with part of a trigger mechanism housing (220). FIG. 3A shows the safety when the sear is in a safe position and the device (250) is in the firing state; FIGS. 4A and 4B show this same configuration from other angles (common axes are shown in the different figures to make it easier to understand the different views), and for reasons of clarity only a trigger bar (210) as a sear and a firing pin (121) are illustrated, but not the trigger mechanism housing (220). In relation to the safety, the sear is located into the path of movement of the firing pin. In relation to the device (250), the actuating element (262) is in the path of movement of the safety body (261)—according to the direction of movement (M), which is parallel or substantially parallel to the axis (X) illustrated— due, in this case, to the action of the pusher (111), which does not push the actuating element (262), allowing the actuating element (262) to be in the first position. Thus, the sear may slide through the safety body (261) if the safety of the weapon would be in the firing position; as it is in the safe position, the sear does not release the firing pin to shoot, preventing the firing pin from moving.

Figure 4A:
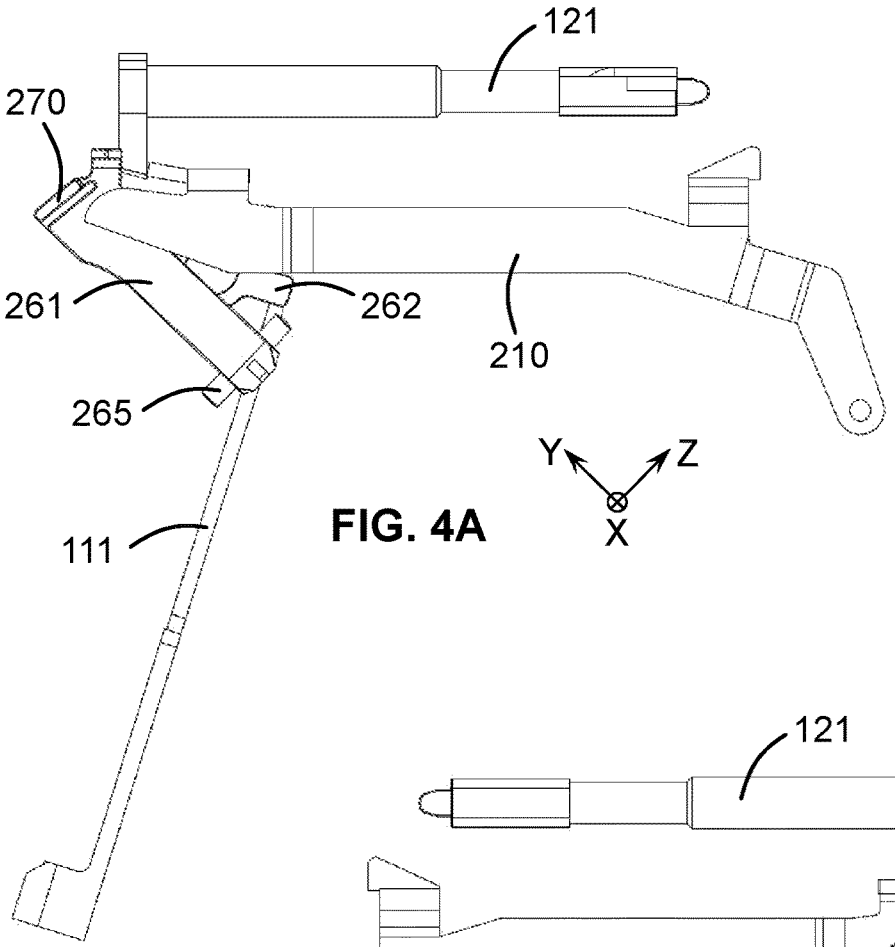
FIGS. 4A-4H show, from other angles, the device configured according to the states of FIGS. 3A-3D.
Figure 4B:
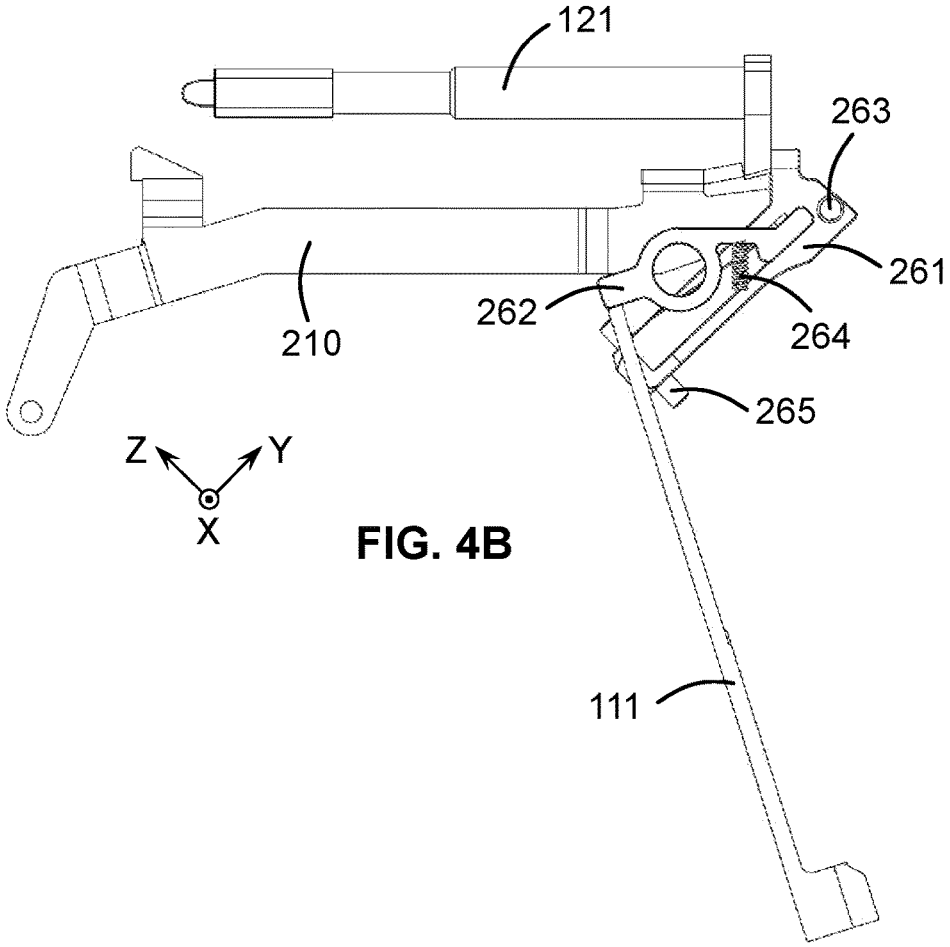
Figure 4C:
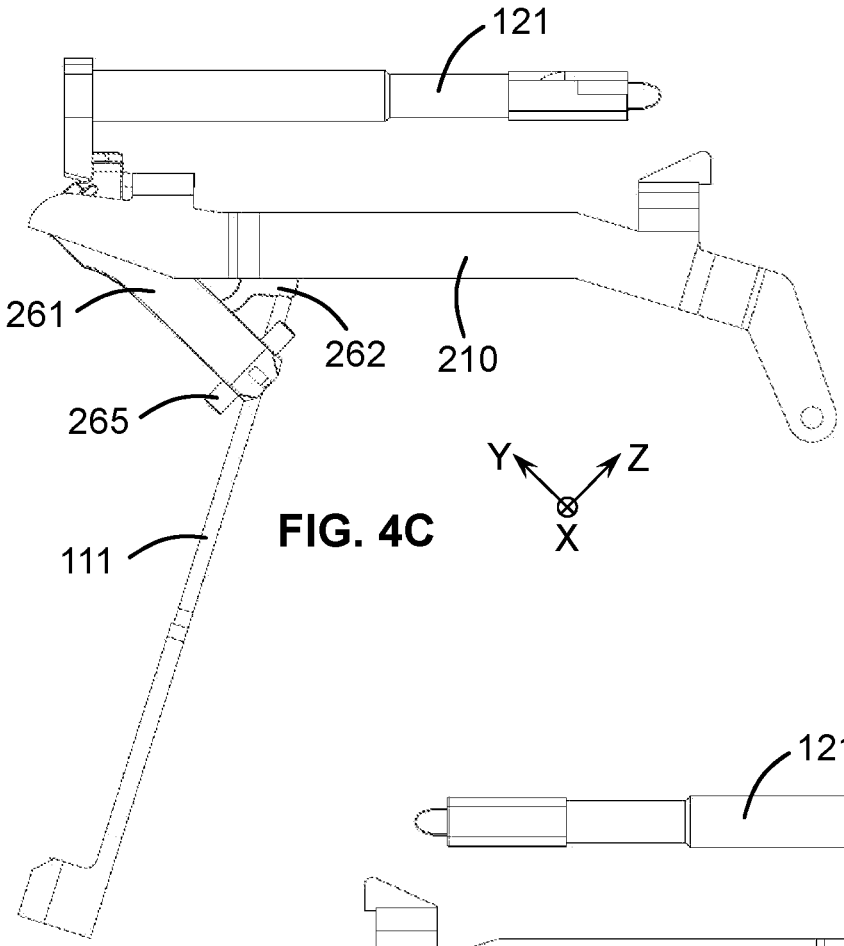
Figure 4D:
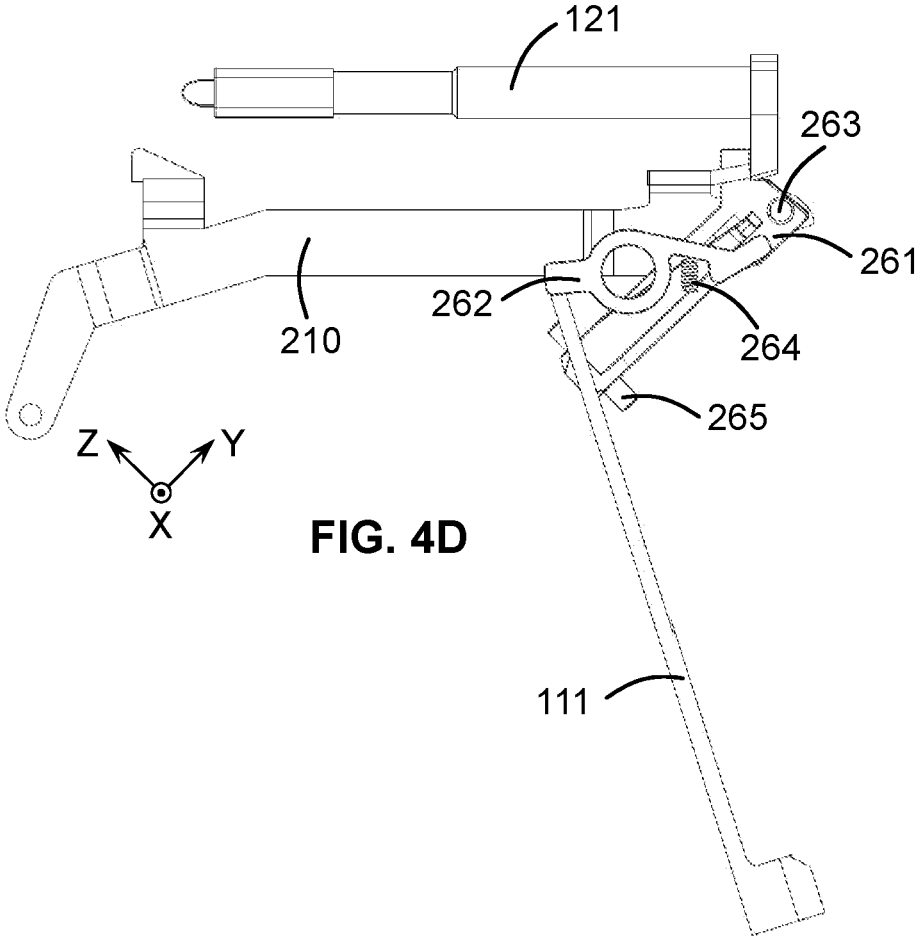

FIG. 3B shows the safety when the sear is in the firing position and the device (250) is in the safe state; FIGS. 4C and 4D show this same configuration from other angles. In relation to the safety, the sear is located into the path of movement of the firing pin. In relation to the device (250), the actuating element (262) is out of the path of movement of the safety body (261)—according to the direction of movement (M)— due, in this case, to the action of the pusher (111), which pushes the actuating element (262) to force it to be in the second position. Thus, the sear cannot slide through the safety body (261) despite the fact that the weapon safety is in the firing position, because the safety body (261) moves according to the direction of movement (M)—due to the shaft (265) of the device (250)—, so the sear cannot press or push the protrusion (270) of the safety body (261) during the entire travel—according to a direction of movement of the sear—. For this reason, the sear cannot release the firing pin to shoot.

Figure 3C:
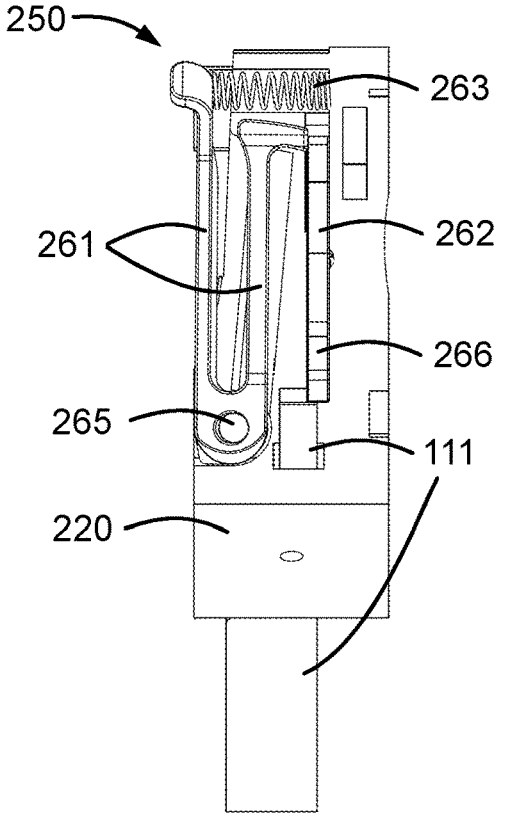
Figure 4E:
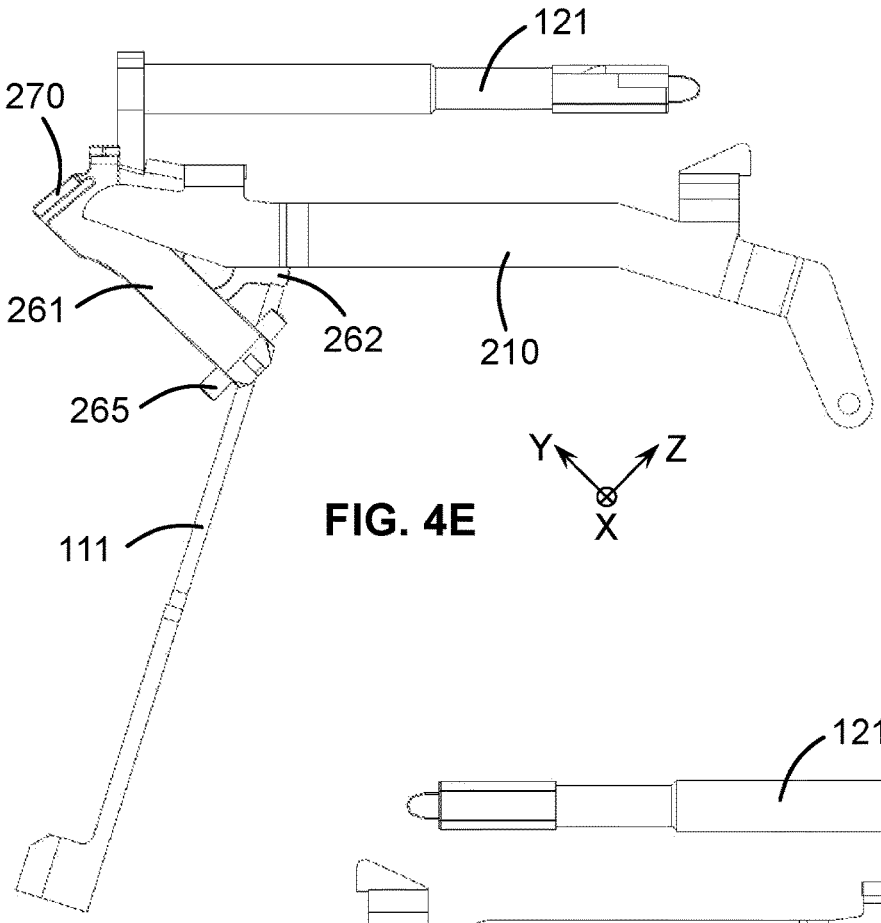
Figure 4F:
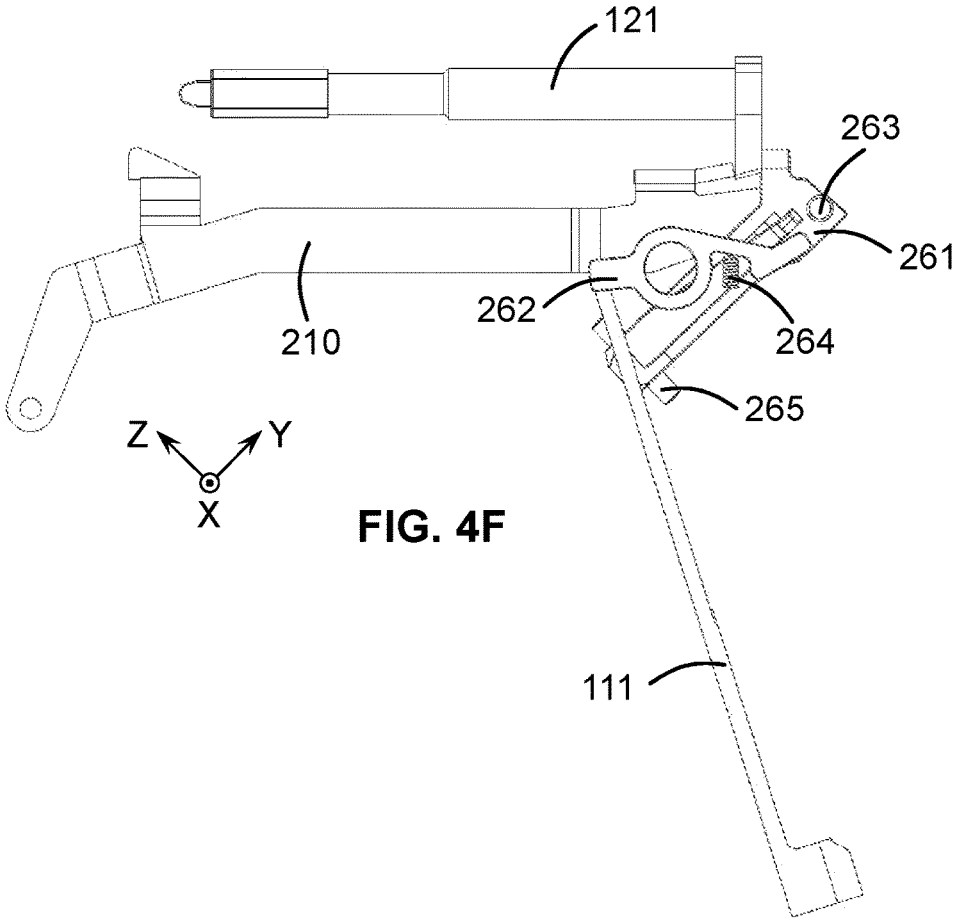

FIG. 3C shows the safety when the sear is in the safe position and the device in the safe state, which prevents the user from shooting; FIGS. 4E and 4F show this same configuration from other angles. In relation to the safety, the sear is located into the path of movement of the firing pin. In relation to the device (250), the actuating element (262) is out of the path of movement of the safety body (261)—according to the direction of movement (M).

Figure 3D:
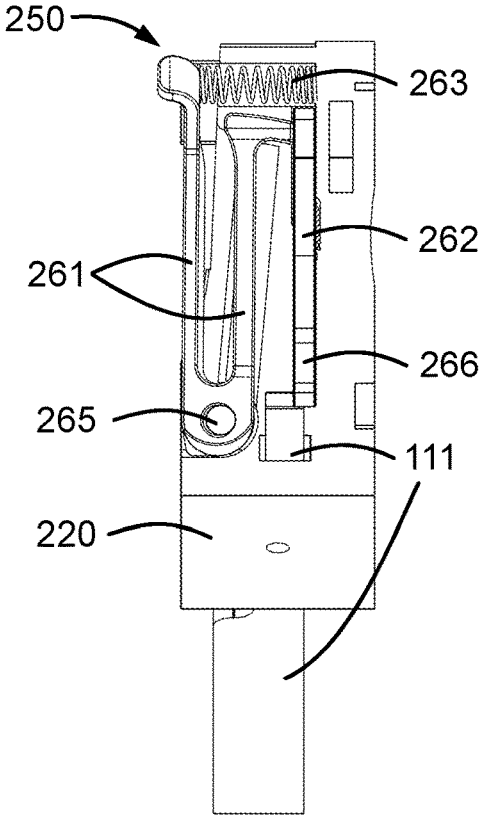
Figure 4G:
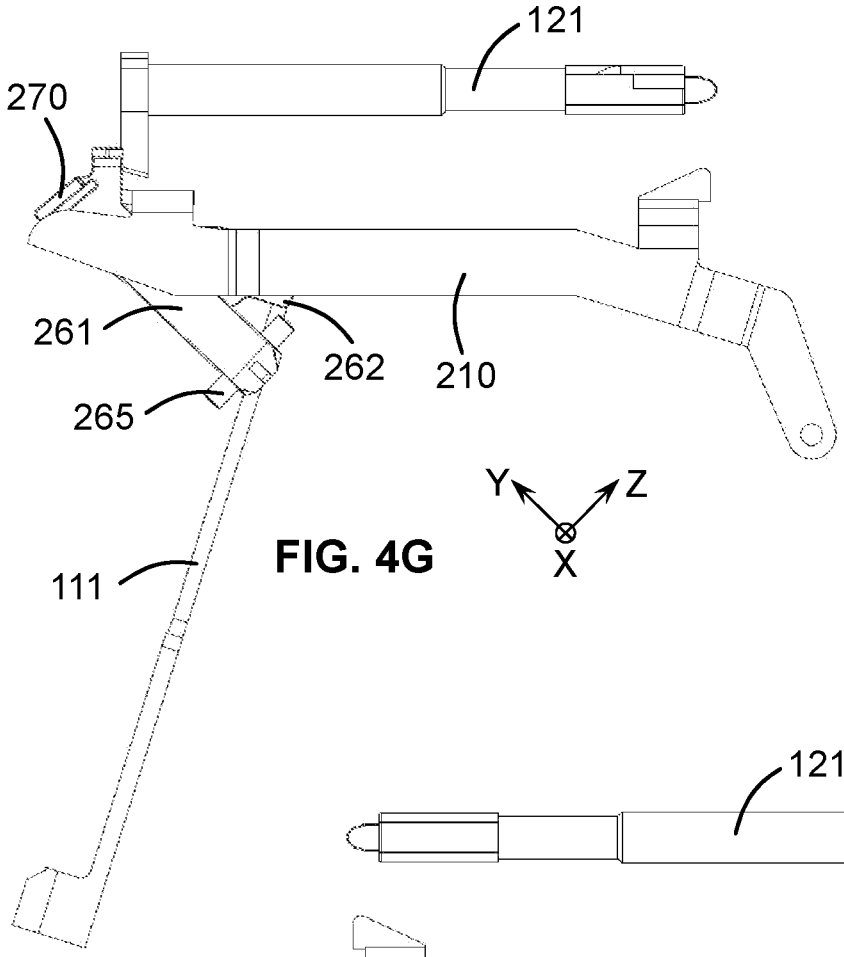
Figure 4H:
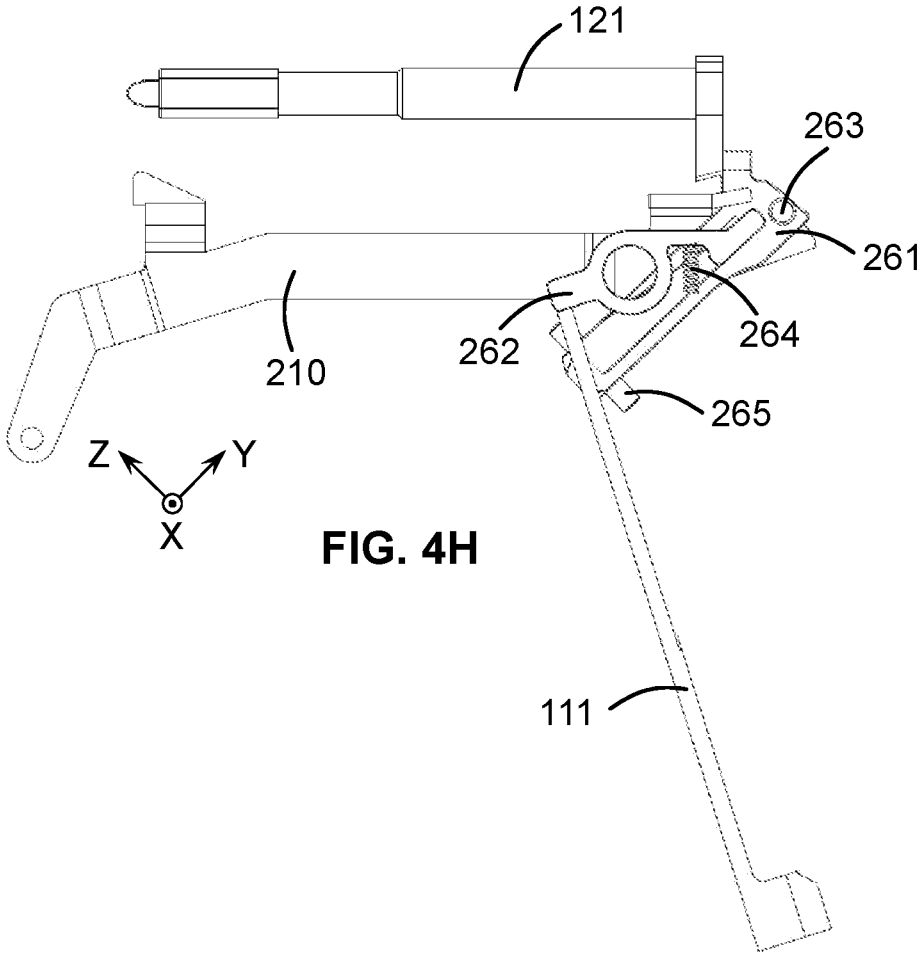

FIG. 3D shows the safety when the sear is in the firing position and the device (250) in the firing state; FIGS. 4G and 4H show this same configuration from other angles. In relation to the safety, the sear is not located into the path of movement of the firing pin. In relation to the device (250), the actuating element (262) is in the path of movement of the safety body (261)—according to the direction of movement (M)—. Thus, the sear slides through the safety body (261) and presses or pushes the protrusion (270) during the entire travel of the sear—according to the direction of movement of the sear-, releasing the firing pin and allowing the user to shoot.

Once the shot has been fired, the device (250) allows the user to fire a new shot if desired after releasing the trigger of the weapon and the firing mechanism has been reassembled as it is known by the person skilled in the art. When the trigger is released, the sear does not release the firing pin but the device (250) remains in the firing state, so when the trigger is pulled again, the sear releases the firing pin again to fire a shot. Therefore, the device (250) does not modify the firing operation of the weapon, this makes the weapon maintain its original firing cadence.

According to FIGS. 3A-3D, normally the direction of movement of the sear is perpendicular to the sheet, that is, it goes in or out of the sheet—it is contained in the plane defined by the axes (Y), (Z) illustrated—. In such embodiments, the direction of movement (M) of the safety body is perpendicular to the direction of movement of the sear.

As shown in FIGS. 3D, 4G and 4H, the safety body (261) cannot move in the direction of movement (M) while the sear slides through the safety body (261). The sear reaches the end of the protrusion (270) and overcomes it, releasing at this moment the firing pin to fire the shot.

In the embodiment of FIGS. 3A-3D, the device (250) includes an elastic element (263) for the safety body, that contacts the safety body (261) and the trigger mechanism housing (220). The elastic element (263) is compressed—according to a compression/extension direction (E1)—according to the pressure of the safety body (261) when it moves according to the direction of movement (M). Afterwards, the elastic element (263) returns to its initial configuration when extended according to the direction of compression/extension (E1), thus returning the safety body (261) to an initial position.

FIGS. 5A-5B show the different positions of the device (250) in the trigger mechanism housing (220) when the trigger is not pulled, according to a preferred embodiment of the disclosure.

FIG. 5A illustrates the device (250) in firing state, where the actuating element (262) is in the first position and, therefore, is in the path of movement of the safety body (261) according to the direction of movement (M). FIG. 5B shows the device (250) in the safe state, where the actuating element (262) is in the second position and therefore is out of the path of movement of the safety body (261) according to the direction of movement (M).

As can be seen, the actuating element (262) is movable between the first and second positions rotating in relation to a direction of rotation (R), which is preferably perpendicular to the direction of movement (M) of the safety body (261). Although not illustrated in FIGS. 5A-5B, but illustrated in FIGS. 2, 3A-3D, 8A-8B, the rotation is carried out thanks to an axis (266) that is arranged in the trigger mechanism housing (220). This axis (266) can be part of the device (250), being a piece adapted to be placed in the said housing, or it can be part of the trigger mechanism housing (220), for example, it can be a protusion on the inside of the housing.

Also, optionally, the device (250) may also comprise an elastic element (264) for the actuating element, which contacts the actuating element (262) and the trigger mechanism housing (220). The elastic element (264) is compressed—according to a compression/extension direction (E2)—according to the pressure made by the actuating element (262) when it rotates according to the direction of rotation (R). Afterwards, the elastic element (264) returns to its initial configuration by extending in the direction of compression/extension (E2), thus returning the actuating element (262) to an initial position if the pusher (111) allows it—that is, if it is not forcing the actuating element (262) to be in the second position—. If while the trigger is being pulled while the device (250) is in the safe state and the device (250) is changed to the firing state, the shot will not occur when this change is made, but thanks to the elastic element (264) the actuating element (262) will move to the first position as soon as the trigger is released, thus configuring the device (250) to the firing state, which allows the shot when the trigger is pulled again.

In some embodiments, the device (250) comprises at least one of: the elastic element (263) for the safety body, and the elastic element (264) for the actuating element. In some of these embodiments, the device (250) includes both elastic elements (263, 264), for example, in the embodiments of FIGS. 2, 3A-3D, 4A-4H, 5A-5B and 8A-8B.

Figure 6:
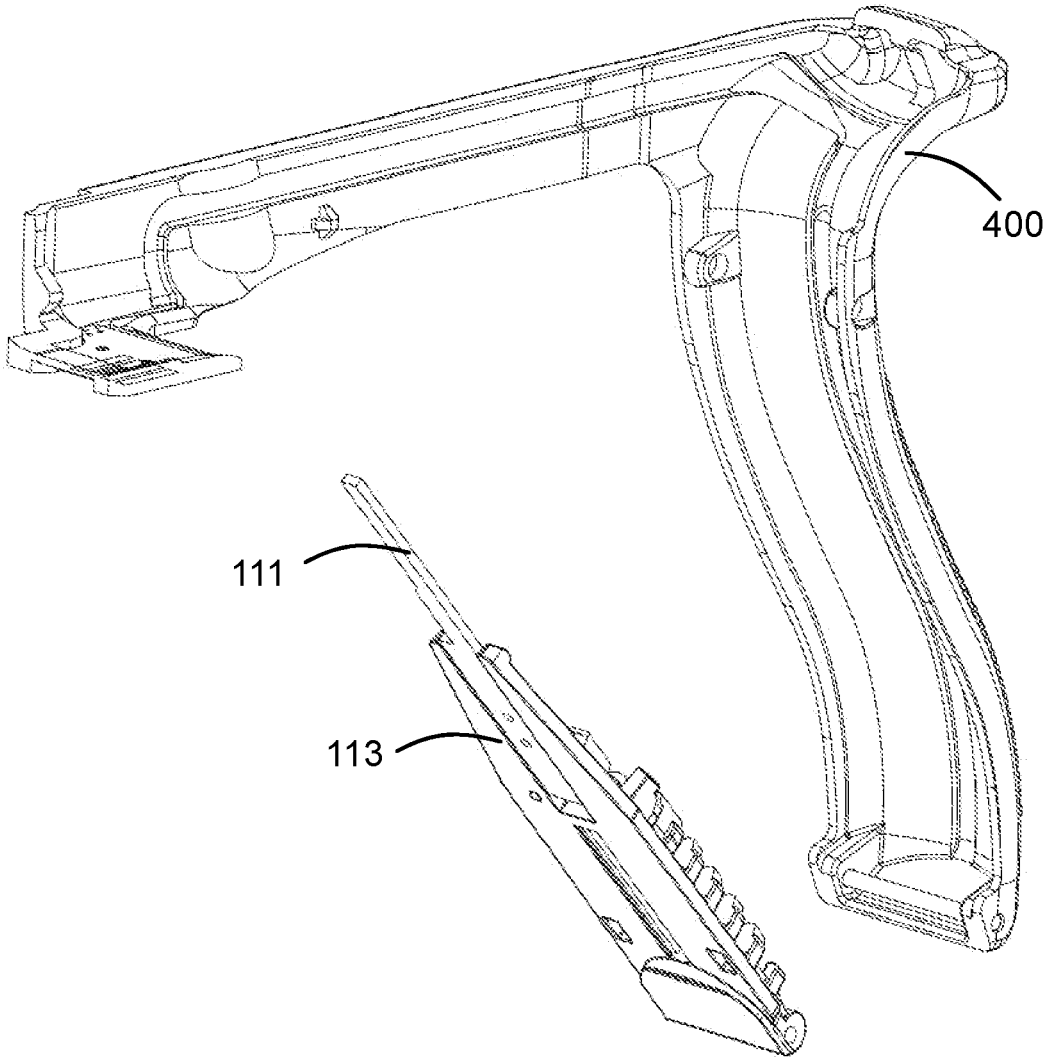
FIG. 6 illustrates in greater detail an exploded perspective view of a backstrap adapter which includes the weapon, or the device of the disclosure according to a preferred embodiment of the disclosure.

FIG. 6 shows a backstrap adapter (400).

In some embodiments, the device is incorporated in the weapon, which is equipped with a backstrap adapter, while in other embodiments the device includes a backstrap adapter (400) as illustrated in FIG. 6.

This backstrap adapter (400) of the device is adapted to receive the motor housing (113) and the pusher (111), as well as a motor when the device is equipped with this. These elements are housed inside the backstrap adapter (400), and the pusher (111) is adapted to contact the actuating element of the device via the backstrap adapter (400).

When a weapon is already equipped with a backstrap adapter, this adapter can be replaced by the backstrap adapter (400) of the device to incorporate the device according to this embodiment.

Figure 7:
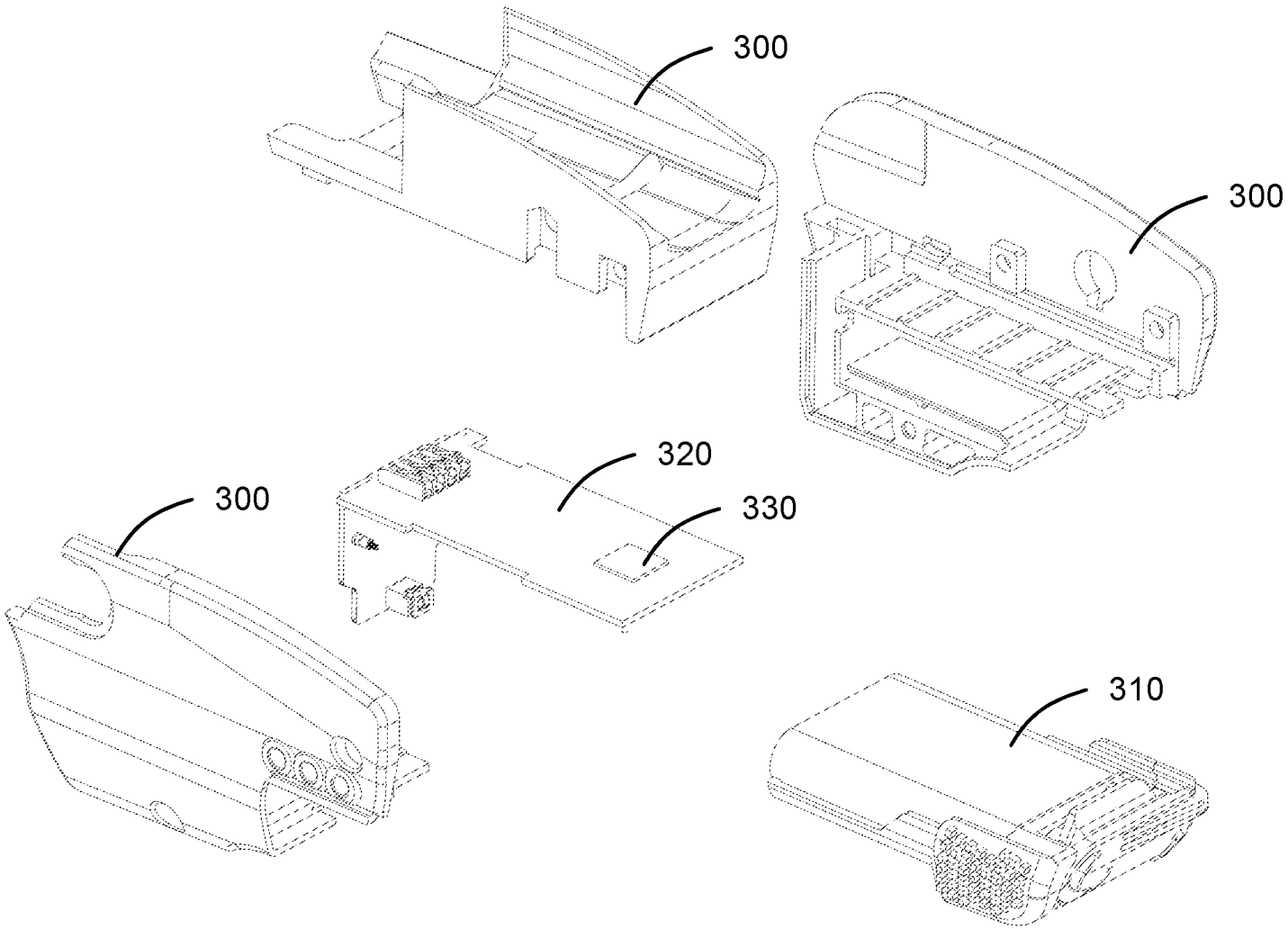
FIG. 7 shows in greater detail an exploded perspective view of a battery housing including the device of the disclosure according to a preferred embodiment.

FIG. 7 shows a battery housing (300) which includes the device of the disclosure according to a preferred embodiment.

The battery housing (300) is made up of different pieces that enable a battery (310) of the device to be housed. A motor of the device is connected to the battery (310) so that it is electrically powered and can operate a pusher. The battery housing (300) can be adapted to be located in the barrel region of the weapon.

The battery housing (300) also houses a sensor circuit (320) and a processing unit (330) of the device connected to the battery (310). By configuring both, it is possible to electronically control the configuration of the device, and/or electronically authorize the change of the device configuration. To this end, the processing unit (330) receives signals from the sensor circuit (320) which, in turn, receives signals from a transmitter module or from one or more buttons to perform such control or authorization. The sensor circuit (320) may have a wireless communications module (not illustrated) that at least allows it to receive data from other devices wirelessly, and may also allow it to transmit data to other devices. Therefore, thanks to these sensor circuit (320) and processing unit (330), it is possible to control the device electronically by the user carrying the weapon, and/or remotely by a user other than the user of the weapon.

For this purpose, the device also comprises a transmitter module (not illustrated) which includes a storage unit configured to store at least the identification code data associated with a user. This storage unit can store identification code data that uniquely identifies the user carrying the transmitter module, and can also store information it receives from the sensor circuit (320), such as the state of the device (firing state/safe state). The transmitter module allows to transmit, wired or wirelessly, coded signals to authorize the change of the device state: in the processing unit (330), the changes of the device state by a user (who carries the weapon or a different user) are authorized, either mechanically or electronically, and, once the authorization is revoked, the processing unit (330) does not allow further changes of the device state until an authorization is reauthorized. Preferably, when the authorization is revoked, the processing unit (330) changes the state of the device to the safe state if it was not.

The transmitter module can also be configured to receive information from an external device, such as a computer device capable of, for example, updating information related to users who can use the transmitter module. The transmitter module may also comprise a processing unit configured to generate the signal representing the identification code data associated with the user, and to manage the storage unit and the data transmission and/or reception stages. When the transmitting module is carried by the user carrying the weapon, the module may be integrated in a wearable device, even in a garment, so that the device only allows the change of state when: the wearable device is carried by the user, the transmitting module so detects it by means of one or more sensors of that module, and the identification code associated with the user of the resulting signal is validated by the processing unit (330) once received by the sensor circuit (320). When the transmitter module is operated by another user, for example, a controlling user, the processing unit (330) may allow the change of state of the device if it has received authorization through the signal with the identification code; for example, in a shooting range, the controlling user may be an instructor who authorizes one or more users to shoot a weapon by sending signals to the sensor circuits of respective devices. The transmitter module may be integrated, for example, in a controller, or even digitally integrated in such a way that it is part of an application in a portable device with communication through mobile phone networks such as, for example, a mobile phone or a tablet.

The sensor circuit (320) is configured to receive coded signals from the transmitter module and, optionally, to send data such as device state (firing state/safe state) to the transmitter module. The sensor circuit (320) can also receive information from any other external device, such as a computer device capable of, for example, updating user-related information with permission to operate the device. The sensor circuit (320) preferably includes a storage unit to store at least the access code data associated with users who are authorized to use the device. The processing unit (330) manages the storage unit and the sensor circuit (320), and is further configured to decode the signal and compare the decoded signal identification code data with the access code data and whether or not to allow the state of the device to change depending on the result of the comparison.

Therefore, the processing unit (330) is configured to compare the received identification code data corresponding to the user operating the transmitter module, with the list of access code data stored in the sensor circuit (320). The access code data can be a listing of the identification code data corresponding to the users who have permission to use the device. When the identification code data received are identical to any of the identification code data of the access code data, the processing unit (330) allows the state of the device to be changed either mechanically and/or electronically. However, when the sensor circuit (320) does not receive any signal or receives a signal corresponding to an unauthorized user, that is, the identification code data received does not match the access code data stored in the weapon, the processing unit (330) does not allow the device configuration change, for example, the motor is not allowed to operate and the actuating element is not moved.

In addition, or alternatively, the device can also be controlled so that its state depends on the shooting direction of the weapon; for example, the device can be configured to be in a safe state when the weapon (100) is aiming outside a predetermined area. To this end, the device further comprises the safety system described in patent document WO2019141885A1, which is incorporated in its entirety by reference. In particular, the sensor circuit (320) includes: an emitter located in a surrounding region of a target and configured to emit a clearance signal; and a receiver which is attachable to the weapon and is part of the sensor circuit. The device may, optionally, comprise the target.

In these cases, the emitter comprises: a light emitting diode adapted to transmit a clearance signal with an encoded identifier; and a first radiation-blocking element comprising a first aperture which restricts emission of the light emitting diode to a first beam; the first beam defining a first enablement area at the receiver in which the clearance signal is received in the receiver. In addition, the receiver comprises: a photodetector, adapted to receive and to measure an optical power of the clearance signal. The light emitting diode and the photodetector must be aligned in an optimal shooting position in which the weapon is aiming at the target for it to be possible to shot.

The processing unit (330) is configured to change the state of the device by actuating the motor (to move the actuating element) and to allow shooting when the following conditions are met: the clearance signal is received by the receiver so that the receiver is within the first enablement area; the measured optical power is above a predefined threshold; and the encoded identifier is validated.

On the other hand, the processing unit (330) can provide the necessary control signals so that the state of the device can be displayed on the weapon, allowing the user carrying the weapon to know whether the device is in a firing or a safe state. Control signals are provided, for example, so that there is a visual indication such as an LED or display that is part of the weapon or device. In other embodiments, the state of the device is shown by means of a mechanical indication, such as by the projection of one of the elements of the device out of the weapon, or otherwise. In some of these embodiments, if there is a mechanical or electrical problem in the weapon, this indication of the state of the device will show that the device is in the firing position, therefore, the user will be able to know this situation and thus be able to avoid an accidental shot.

Figure 8A:
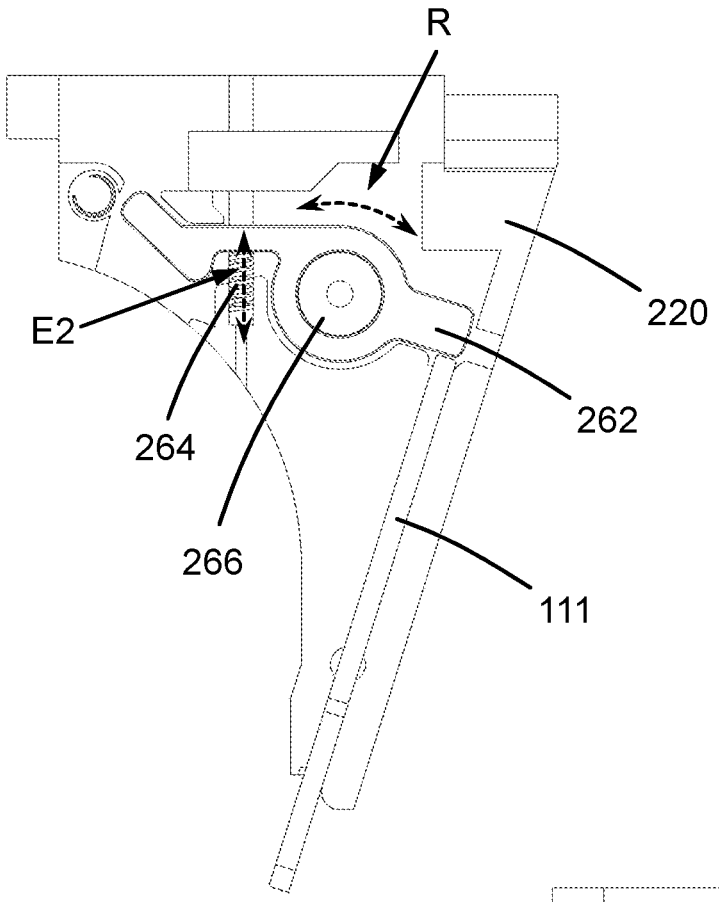
FIGS. 8A-8B illustrate two detailed views of the elastic element for the actuating element in firing position and in safe position, respectively.
Figure 8B:
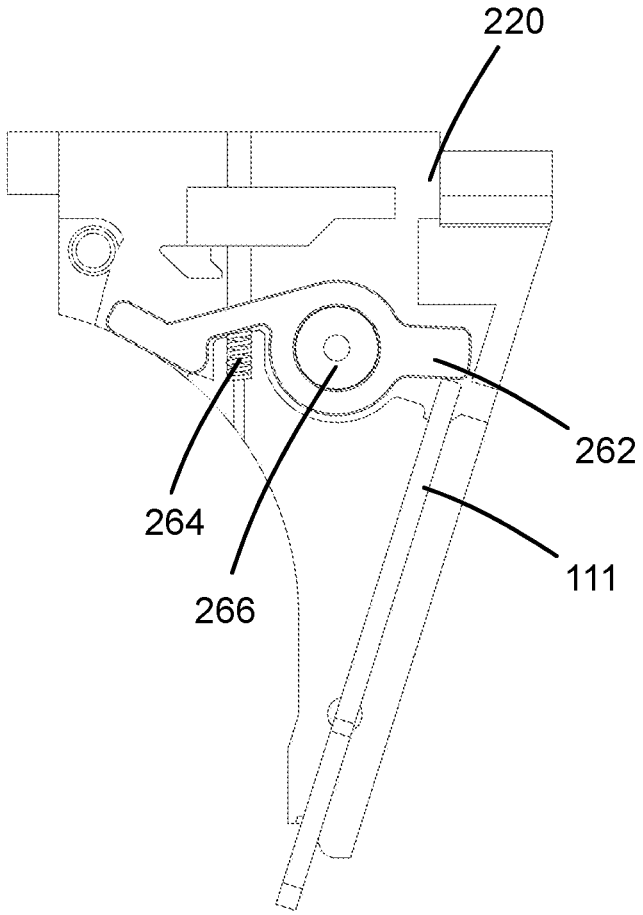

FIGS. 8A-8B show the device (250) in a preferred embodiment, where the elastic element (264) for the actuating element is arranged between the trigger mechanism housing (220) and the actuating element (262).

FIG. 8A shows a detailed view of the firing state, where the actuating element (262) is in the path of movement of the safety body according to the direction of movement (M).

FIG. 8B shows a detailed view of the safe state, where the actuating element (262) is out of the path of movement of the safety body according to the direction of movement (M). The actuating element (262) moves between these positions by rotating in the direction of rotation (R) around the axis (266).

In this text, the term "comprises" and its derivatives (such as "which comprises", etc.) should not be understood in an excluding sense, that is, these terms should not be interpreted as excluding the possibility that what is described and defined may include other elements, stages, etc.

The present disclosure is obviously not limited to the specific embodiments described in this document, but also includes any variation that may be considered by any person skilled in the art within the general scope of the disclosure, as defined in the claims.

The invention claimed is:

1. A device for securing a weapon with a safety, the safety comprising a sear movable between a safe position that prevents a firing pin of the weapon from being released and a firing position that allows the firing pin to be released when a trigger of the weapon is pulled, the device comprising:

a safety body adapted to contact the sear, and an actuating element movable between: a first position in which the actuating element is located into a path of movement of the safety body in a direction of movement of the safety body, and a second position in which the actuating element is located out of the path of movement of the safety body in the direction of movement of the safety body;

wherein the actuating element and the safety body are adapted to make the device configurable between at least:

a firing state in which the actuating element is in the first position, preventing-the safety body from moving in the direction of movement, causing the sear to slide through the safety body, and thereby releasing the firing pin only when the sear is in the firing position, thus allowing a user to shoot; and a safe state in which the actuating element is in the second position, allowing movement of the safety body in the direction of movement, causing the sear not to slide through the safety body, and thereby preventing release of the firing pin and not allowing the user to shoot neither when the sear is in the firing position nor when the sear is in the safe position.

2. The device according to claim 1, further comprising a first elastic element for the safety body that contacts the safety body and adapted to contact a trigger mechanism housing of the weapon, wherein the first elastic element for the safety body is configured to arrange the safety body in a contact position with the sear.

3. The device according to claim 1, further comprising a second elastic element for the actuating element that contacts the actuating element and adapted to contact a trigger mechanism housing of the weapon, wherein the second elastic element for the actuating element is to arrange the actuating element in the first position.

4. The device according to claim 3, wherein the second elastic element for the actuating element is configured to bias the actuating element into the first position.

5. The device according to claim 1, further comprising a pusher to change the configuration of the device from the firing state to the safe state, wherein the pusher is configured to at least one of: displace the actuating element from the first position to the second position, and change the configuration of the device from the safe state to the firing state by displacing the actuating element from the second position to the first position.

6. The device according to claim 5, further comprising: a battery, a motor joined to the pusher; a processing unit; and a sensor circuit electrically connected to the battery in order to control the state of the device.

7. The device according to claim 6, wherein the sensor circuit is configured to wirelessly receive a signal which represents a configuration instruction of the device to the safe state or of configuration of the device to the firing state; and the processing unit is configured to process that signal and to operate the motor so that the pusher moves the actuating element to the first position or to the second position according to the instruction of that signal.

8. The device according to claim 6, further comprising a transmitter module configured to transmit, to the sensor circuit, a signal which represents at least an identification code associated with a user; the processing unit is configured to validate the at least one identification code of the received signal by the sensor circuit and to allow the change of the state of the device and, as a function of the validation, to allow or to prevent the change of the state of the device between the firing and safe states by the user of the weapon or by another different user to the user of the weapon.

9. The device according to claim 6, wherein:

the device is configured to at least one of remain in the safe state and switch to the safe state when the weapon points outside a predetermined area;

the device further comprises an emitter located in a surrounding region of a target and configured to emit a clearance signal, comprising the emitter a light emitting diode and a first radiation-blocking element comprising a first aperture; and the sensor circuit comprises a receiver which is attachable to the weapon, the receiver comprising a photodetector, adapted to receive and to measure an optical power of the clearance signal.

10. The device according to claim 1, wherein the actuating element is a lever or a rocker arm.

11. A trigger mechanism housing for a weapon comprising a device for securing a weapon with a safety, the safety comprising a sear movable between a safe position that prevents a firing pin of the weapon from being released and a firing position that allows the firing pin to be released when a trigger of the weapon is pulled, the device comprising:

a safety body adapted to contact the sear, and an actuating element movable between: a first position in which the actuating element is located into a path of movement of the safety body in a direction of movement of the safety body, and a second position in which the actuating element is located out of the path of movement of the safety body in the direction of movement of the safety body;

wherein the actuating element and the safety body are adapted to make the device configurable between at least:

a firing state in which the actuating element is in the first position, preventing the safety body from moving in the direction of movement, causing the sear to slide through the safety body, and thereby releasing the firing pin only when the sear is in the firing position, thus allowing a user to shoot; and a safe state in which the actuating element is in the second position, allowing movement of the safety body in the direction of movement, causing the sear not to slide through the safety body, and thereby preventing release of the firing pin and not allowing the user to shoot neither when the sear is in the firing position nor when the sear is in the safe position.

12. A weapon comprising:

a device for securing a weapon with a safety or a trigger mechanism housing comprising the device;

a firing pin;

a trigger; and a safety with a sear movable between a safe position that prevents the firing pin from being released and a firing position that allows the firing pin to be released when the trigger is pulled;

wherein the device comprises a safety body adapted to contact the sear, and an actuating element movable between: a first position in which the actuating element is located into a path of movement of the safety body in a direction of movement of the safety body, and a second position in which the actuating element is located out of the path of movement of the safety body in the direction of movement of the safety body;

wherein the actuating element and the safety body are adapted to make the device configurable between at least:

a firing state in which the actuating element is in the first position, preventing the safety body from moving in the direction of movement, causing the sear to slide through the safety body, and thereby releasing the firing pin only when the sear is in the firing position, thus allowing a user to shoot; and a safe state in which the actuating element is in the second position, allowing movement of the safety body in the direction of movement, causing the sear not to slide through the safety body, and thereby preventing release of the firing pin and not allowing the user to shoot neither when the sear is in the firing position nor when the sear is in the safe position.

13. The weapon according to claim 12, wherein the safety body is a connector of the weapon.

14. A method for securing a weapon using a device and a safety, the safety comprising a sear movable between a safe position that prevents a firing pin of the weapon from being released and a firing position that allows the firing pin to be released when a trigger of the weapon is pulled, the device comprising a movable actuating element and a safety body, the method comprising:

arranging the device in the weapon in such a way that contacts the sear;

sliding the sear through the safety body such that the firing pin can be released to allow a user to shoot when the actuating element is in a first position, which is in a path of movement of the safety body in a direction of movement, and does not allow movement of the safety body in the movement direction only when the sear is in the firing position;

preventing the sear from sliding through the safety body such that the firing pin cannot be released to prevent the user from shooting when the actuating element is in a second position, which is out of the path of movement of the safety body and allows movement of the safety body in the direction of movement, neither when the sear is in the firing position nor when the sear is in the safe position; and moving the actuating element between the first position and the second position to allow the sear to slide and to prevent the sear from sliding through the safety body, respectively.

15. The method according to claim 14, wherein:

the device is a device for securing the weapon with the safety, wherein the safety body is adapted to contact the sear, and an actuating element movable between: a first position in which the actuating element is located into a path of movement of the safety body in a direction of movement of the safety body, and a second position in which the actuating element is located out of the path of movement of the safety body in the direction of movement of the safety body;

wherein the actuating element and the safety body are adapted to make the device configurable between at least:

a firing state in which the actuating element is in the first position, preventing the safety body from moving in the direction of movement, causing the sear to slide through the safety body, and thereby releasing the firing pin only when the sear is in the firing position, thus allowing a user to shoot; and a safe state in which the actuating element is in the second position, allowing movement of the safety body in the direction of movement, causing the sear not to slide through the safety body, and thereby preventing the release of the firing pin and not allowing the user to shoot neither when the sear is in the firing position nor when the sear is in the safe position; or the weapon comprises a trigger mechanism housing comprising the device; or the weapon is a weapon comprising: the firing pin, the trigger, and the safety.

16. The device according to claim 1, wherein the direction of movement of the safety body is perpendicular to one direction of movement of the sear.

17. The trigger mechanism housing according to claim 11, wherein the direction of movement of the safety body is perpendicular to one direction of movement of the sear.

18. The weapon according to claim 12, wherein the direction of movement of the safety body is perpendicular to one direction of movement of the sear.

19. The weapon according to claim 12, wherein the weapon comprises the trigger mechanism housing and the device further comprises a first elastic element for the safety body that contacts the safety body and is adapted to contact the trigger mechanism housing, wherein the first elastic element for the safety body is configured to arrange the safety body in a contact position with the sear.

20. The method according to claim 14, wherein the direction of movement of the safety body is perpendicular to one direction of movement of the sear.

* * * * *